United States Patent [19]

Matsuda

[11] 4,265,003

[45] May 5, 1981

[54] WARP-KNIT TAPE FABRIC FOR SLIDE FASTENERS

[75] Inventor: Yoshio Matsuda, Nyuzen, Japan

[73] Assignee: Yoshida Kogyo K.K., Tokyo, Japan

[21] Appl. No.: 62,549

[22] Filed: Jul. 31, 1979

[30] Foreign Application Priority Data

Jul. 31, 1978 [JP] Japan ..... 53-105406[U]

[51] Int. Cl.[3] ..... A44B 19/00

[52] U.S. Cl. ..... 24/205.1 C; 66/195; 66/193; 24/205.16 R

[58] Field of Search ..... 66/190–195; 24/205.1 C, 205.16

[56] References Cited

U.S. PATENT DOCUMENTS

| | | | |
|---|---|---|---|
| 3,757,541 | 9/1973 | Fröhlich et al. | 66/193 |
| 3,762,002 | 10/1973 | Fröhlich et al. | 66/195 X |
| 3,974,549 | 8/1976 | Matsuda | 66/195 X |

FOREIGN PATENT DOCUMENTS

| | | | |
|---|---|---|---|
| 1299919 | 12/1972 | United Kingdom | 66/195 |

*Primary Examiner*—Ronald Feldbaum

*Attorney, Agent, or Firm*—Robert E. Burns; Emmanuel J. Lobato; Bruce L. Adams

[57] ABSTRACT

A plurality of elongate warp-knit webs are connected side by side by water-soluble connecting threads along their longitudinal edges. The warp-knit webs are arranged in connected pairs each having a pair of opposed marginal edge portions for supporting a pair of rows of coupling elements, respectively. The connecting thread extends between and interconnects inner wales adjacent to the outermost wales in the opposed marginal edge portions in each pair of the warp-knit webs. The outermost wale is formed solely with a single thread and is shifted into contact with the inner wale, thereby providing a single widened wale along a longitudinal edge of the web. Between the opposed longitudinal marginal edges of the paired webs, there is a gap or clearance that is small enough to make a slide fastener sightly and resistant to being split open under accidental conditions.

4 Claims, 4 Drawing Figures

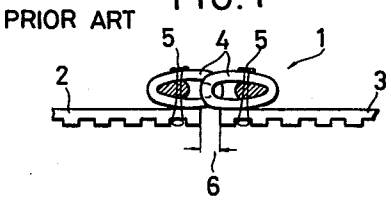
PRIOR ART FIG. 1
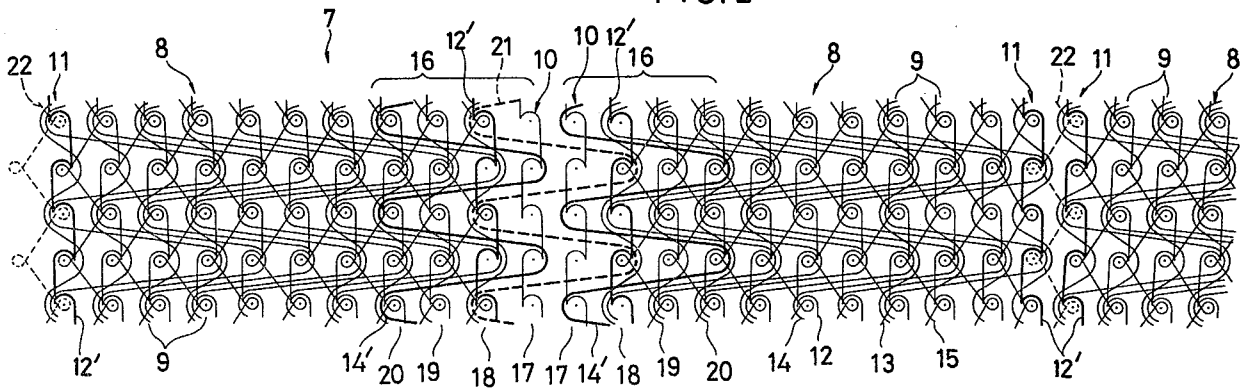
FIG. 2

WARP-KNIT TAPE FABRIC FOR SLIDE FASTENERS

BACKGROUND OF THE INVENTION

1. Field of the Invention

The present invention relates to slide fasteners and more particularly to such a slide fastener having a warp-knit tape.

2. Prior Art

Slide fasteners have a longitudinal gap or space between a pair of opposed longitudinal tape edges on which a pair of interengaged rows of coupling elements are arranged. The wider the gap, the less sightly the slide fastener becomes and the greater and possibility it will split apart when subjected to sudden forces. The gap becomes wider when coupling elements of larger sizes are mounted on the tape edges, often resulting in unintentional "rupture" or split of the fastener chain.

British Pat. No. 1,299,919 is believed to be a close prior art; however, the warp-knit stringer tape disclosed therein cannot evade the possibility of its edge curling up or otherwise becoming unstable for the proper mounting of the fastener element. Further, the rows of interlocking fastener elements are attached to the warp-knit stringer tapes by insertion instead of stitching.

U.S. Pat. No. 3,974,549, issued on Aug. 17, 1976 discloses a warp-knitted tape for slide fastener, having a reinforced marginal edge portion on which a row of coupling elements is mounted by sewing stitches. However, a slide fastener using a pair of such warp-knitted tapes would have a larger gap between the tapes if larger coupling elements were sewn to the opposed tape edges.

SUMMARY OF THE INVENTION

It is an object of the present invention to provide a slide fastener including a pair of warp-knit stringer tapes with a narrowed gap between a pair of opposed longitudinal edges on which a pair of respective rows of coupling elements are mounted.

Another object of the invention is to provide a slide fastener having a pair of warp-knit stringer tapes each with a longitudinal edge reinforced such that the coupling element mounted thereon can maintain its proper operative posture against external forces.

According to the present invention, the outermost wales of the warp knit tapes are comprised solely of a single thread and are displaced into contact with the adjacent inner wales by transverse lain-in threads extending across the wales in the warp knit webs. The outermost wale and the adjacent inner wales are thus joined in each warp-knit web so as to provide a single widened wale along the longitudinal edge of the web. With the warp-knit webs disposed in opposed relation and each supporting a respective row of coupling elements thereon, there is a small gap or clearance between the opposed longitudinal edges of the warp-knit webs.

BRIEF DESCRIPTION OF THE DRAWINGS

The above and other objects, advantages and features of the present invention will become apparent from the following description of the preferred embodiment, taken in conjunction with the accompanying drawings, in which:

FIG. 1 is a transverse cross-sectional view of a slide fastener according to the prior art;

FIG. 2 is a point diagram for a warp-knit composite fabric structure constructed in accordance with the present invention;

DESCRIPTION OF THE PREFERRED EMBODIMENT

Figure 3:
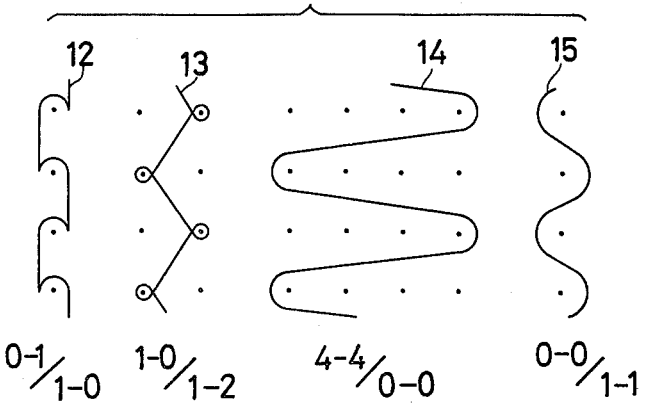
FIG. 3 is a view showing stitch patterns for individual threads used in the fabric structure shown in FIG. 2.

FIG. 1 shows a conventional slide fastener 1 having a pair of warp-knit stringer tapes 2, 3 supporting on their opposed longitudinal edges a pair of rows of coupling elements 4 secured to the stringer tapes 2, 3 by sewing threads 5. There is a gap or clearance 6 formed between the opposed longitudinal edges of the stringer tapes 2, 3. The gap 6, when widened excessively, makes the slide fastener 1 unsightly and renders it vulnerable to malfunctioning during its use. For example, the closed slide fastener 1 tends to split apart when thrusted, bent over, or pulled apart with a sudden force.

In addition, since the sewing threads 5 extend through the tapes 2, 3 normally at a position between an outermost wale and an inner successive wale, attachment of coupling elements of different sizes, particularly of larger sizes results in wider gaps between the stringer tapes. In order to keep the gap constant between the stringer tapes supporting larger coupling elements, it has been customary to change the gauge in a knitting machine for a different wale width, which however has been a time-consuming, troublesome procedure.

In FIG. 2, a warp-knit composite fabric structure 7 according to the present invention comprises a plurality of parallel elongate warp-knit webs 8 interconnected side by side. Each of the warp-knit webs 8 has a plurality of longitudinal wales 9 juxtaposed between a pair of first and second longitudinal edges 10,11. As best shown in FIG. 3, each warp-knit web 8 except for its outermost wale portion is composed of a plurality of first threads 12 knit in a pattern of 0-1/1-0, a plurality of second threads 13 knit in a pattern of 1-0/1-2, a plurality of third threads 14 laid in a pattern of 4-4/0-0, and a plurality of fourth threads 15 laid in a pattern of 0-0/1-1.

Each third thread 14 extends transversely across four adjacent wales 9. Each warp-knit web 8 has a longitudinal marginal edge portion 16 extending along the first longitudinal edge 10. The marginal edge portion 16 includes a first outermost wale 17 at the first longitudinal edge 10, a second inner successive wale 18, a third inner successive wale 19, and a fourth inner successive wale 20.

The first outermost wale 17 is formed solely with one of the first threads 12. One of the transverse laid-in third threads 14' which extends across the first, second, third, and fourth wales 17, 18, 19, 20 and engages the first and fourth wales 17, 20 is thicker than the outer transverse laid-in third threads 14. One of the first threads 12' which constitutes the second inner successive wale 18 is reinforced or made thicker than the other first threads 12. The longitudinal marginal edge portion 16 is thus reinforced to provide rigid support for a row of coupling elements as described later on.

The first, second, and third wales 17,18,19 are pulled toward the fourth wale 20 by the respective transverse laid-in threads 14 engaging the wales 17,18,19. Since the first outermost wale 17 is constructed solely with the first thread 12, the first wale 17 is the most unstable positionally and thus is displaced laterally substantially into contact with the second wale 18 by the tension of laid-in threads 14' applied inwardly of the tape and by the fact that the second wale 18 is restricted from moving toward the fourth wale 20 by the connecting thread 21. The third wale 19 is the second weakest positionally and hence is appreciably displaced toward the fourth wale 20 by the tension of the laid in thread 14.

The first longitudinal edges 10,10 of adjacent two of the warp-knit webs 8,8 are disposed in confronting relation to each other. The adjacent two of the warp-knit webs 8,8 are joined along their first longitudinal edges 10,10 by a connecting thread 21 of synthetic fibers that are water-soluble at a first temperature. The connecting thread 21 is laid in a pattern of 4-4/0-0 and interconnects the second successive wales 18,18 in the adjacent two warp-knit webs 8,8.

The interconnected second wales 18,18 remain spaced from the adjacent third wales 19,19, respectively, leaving spaces or interwale grooves 26,26 therebetween for receiving sewing threads 25,25, in which instance the threads 25,25 are retained in place by the use of reinforced first threads 12' forming the second wale 18.

The thickened yarns 12'', constituting the second inner wall 18 also serves to stiffen the second longitudinal edge 11 so as to prevent the latter from curling up or getting otherwise deformed. The second longitudinal edge 11,11 of adjacent two warp-knit webs 8,8 are interconnected by a connecting thread 22 of synthetic fibers that are water-soluble at a second temperature lower than the first temperature. The connecting thread 22 is knit in a pattern of 1-0/1-2 interconnecting the opposed second longitudinal edges 11,11.

The warp-knit composite fabric structure 7 is heat-set to secure the knit arrangement thus provided. Then, the warp-knit composite fabric structure 7 is dipped into water at the second temperature to dissolve the connecting threads 22. A pair of rows of coupling elements are sewn to the opposed longitudinal marginal edge portions 16,16 of a connected pair of the adjacent warp-knit webs 8, 8. The warp-knit webs 8, 8 with the rows of coupling elements thereon are dipped into water at the first temperature, thereby removing the connecting thread 21 to separate the warp-knit webs 8, 8 from each other.

Figure 4:
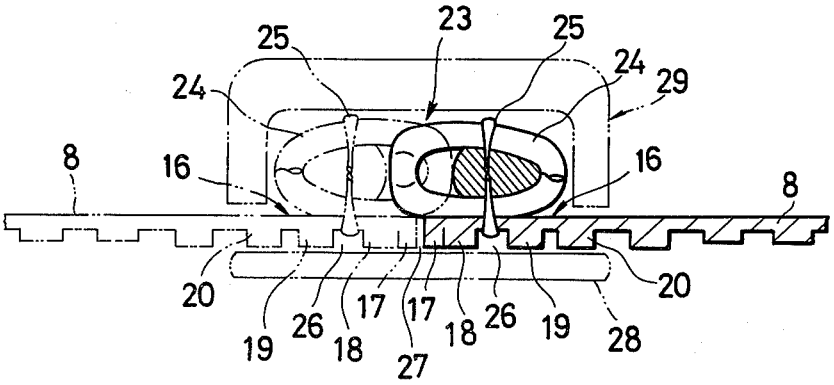
FIG. 4 is an enlarged cross-sectional view of a slide fastener having a pair of warp-knit stringer tapes of the present invention.

In FIG. 4, a slide fastener 23 comprises a pair of stringer tapes constituted by an adjacent pair of the warp-knit webs 8, 8 with the first longitudinal edges 10,10 confronting each other, and a pair of interengaged rows of coupling elements 24,24 mounted on a flat side of each tape along the marginal edge portions 16,16, respectively, by a pair of sewing threads 25,25. Each sewing thread 25 extends through the tape web 8 at one of the interwale grooves 26 between the second and third wales 18,19.

With such an arrangement, the first and second wales 17, 18 located outwardly of the sewing thread 25 are brought together into a single widened wale along the first longitudinal edge 10. Accordingly, the opposed longitudinal edges of the warp-knit tape webs 8, 8 are located close to each other, leaving a relatively small gap or clearance 27 therebetween. At the same time, the first wale 17 is prevented from curling or bending which would otherwise take place if it were for the interwale gap between the first and second wales 17,18. In addition, the longitudinal marginal edge portions 16,16 in which the wales 17,18,19,20 are compacted provide a rigid surface for the lower wing 28 of a slider 29 to slide smoothly thereon.

Although a preferred embodiment has been shown and described in detail, it should be understood that various changes and modifications can be made therein without departing from the scope of the appended claims.

What is claimed is:

1. A slide fastener comprising:

(a) a pair of warp-knit stringer tapes each having a plurality of longitudinal wales and alternate grooves between a pair of first and second longitudinal edges of the tape, each of said warp-knit tapes including a plurality of transverse threads extending transversely across a plurality of adjacent ones of said wales, said wales including a first outermost wale at said first longitudinal edge, a reinforced second inner successive wale adjacent to said first outermost wale, a third inner successive wale adjacent to said second inner successive wale, one of said transverse threads which engages said first outermost wale being thicker than the outer transverse threads, said stringer tapes positioned with the first longitudinal edges of the stringer tapes confronting each other, and said transverse threads being effective for pulling said first outermost wale into contact with said second inner successive wale to define a combined widened wale portion;

(b) a pair of rows of coupling elements mounted on a flat side of the respective stringer tape along said first longitudinal edge;

(c) a pair of stitches of sewing threads securing the respective rows of coupling elements to the corresponding stringer tapes respectively along said first longitudinal edges, each of said stitches of sewing threads extending through one of said stringer tape at a groove between said second and third wales.

2. A slide fastener according to claim 1, each of said transverse threads extending across four adjacent wales.

3. A slide fastener according to claim 2, each of said transverse threads having a pattern of 4-4/0-0.

4. A slide fastener according to claim 1, each of said warp-knit webs comprising a plurality of first threads knit in a pattern of 0-1/1-0, a plurality of second threads knit in a pattern of 1-0/1-2, a plurality of third threads having a pattern of 4-4/0-0, and a plurality of fourth threads having a pattern of 1-1/0-0, said first outermost wale being formed solely with one of said first threads.

* * * * *